US006003739A

United States Patent [19]

Bartlett et al.

[11] Patent Number: 6,003,739

[45] Date of Patent: Dec. 21, 1999

[54] AEROSOL SPRAY ACTUATOR BAR

[76] Inventors: Louie E. Bartlett; Sharon L. Bartlett, both of 223 M-M Park, Box 11, Justin, Tex. 76247

[21] Appl. No.: 09/031,784

[22] Filed: Feb. 27, 1998

[51] Int. Cl.[6] ..... B65D 83/00

[52] U.S. Cl. ..... 222/402.1; 222/402.13

[58] Field of Search ..... 222/402.1, 402.13; 239/337

[56] References Cited

U.S. PATENT DOCUMENTS

| | | | |
|---|---|---|---|
| 2,573,624 | 10/1951 | Svendsen | 299/95 |
| 2,746,796 | 5/1956 | St. Germain | 239/337 X |
| 2,757,963 | 8/1956 | Drell | 239/337 |
| 2,775,483 | 12/1956 | Treharne, Jr. et al. | 239/402.13 X |
| 3,138,331 | 6/1964 | Kutik | 239/337 |
| 3,184,118 | 5/1965 | Webster | 239/337 X |
| 3,333,744 | 8/1967 | Nilsen et al. | 222/402.13 |
| 3,361,301 | 1/1968 | Meshberg | 222/402.13 X |
| 3,495,922 | 2/1970 | Steinman | 222/402.1 X |
| 3,726,445 | 4/1973 | Ostrowsky et al. | 222/402.11 |
| 3,854,632 | 12/1974 | Smrt | 222/182 |
| 3,884,398 | 5/1975 | McLaughlin | 222/402.13 |
| 3,907,175 | 9/1975 | Haas | 222/402.13 |
| 3,915,353 | 10/1975 | Haas | 222/402.1 |
| 3,993,251 | 11/1976 | Des Garets | 222/402.13 X |
| 4,089,440 | 5/1978 | Lee | 222/174 |
| 4,129,235 | 12/1978 | Haas | 222/402.13 X |
| 4,328,911 | 5/1982 | Knickerbocker | 222/182 |
| 4,416,398 | 11/1983 | Knickerbocker | 222/402.13 |
| 4,428,512 | 1/1984 | Nosek | 222/402.15 |
| 5,477,990 | 12/1995 | Saito et al. | 222/321.6 X |

FOREIGN PATENT DOCUMENTS

| | | |
|---|---|---|
| 0655396 | 5/1995 | European Pat. Off. . |
| 9611151 | 4/1996 | WIPO . |

*Primary Examiner*—Kevin Shaver
*Assistant Examiner*—Keats Quinalty
*Attorney, Agent, or Firm*—John A. Thomas

[57] ABSTRACT

An actuator bar is disclosed for an aerosol spray container of the type utilizing a tubular valve stem, the actuator bar having a top surface large enough to accommodate two fingers. The actuator bar has two embodiments. One embodiment fits over an existing actuator button and has a bottom opening for slideably mounting over the actuator button a side-wall opening to permit the exit of aerosol spray. The second embodiment comprises body having a the front side-wall with a terminal orifice for dispensing fluids from the aerosol spray container and further has a fluid flow passageway in the body extending from the bottom to the front side-wall and having an inlet portion for the inlet of aerosol spray fluid and an outlet portion in fluid flow communication with the terminal orifice.

2 Claims, 1 Drawing Sheet

AEROSOL SPRAY ACTUATOR BAR

FIELD OF THE INVENTION

The invention relates to aerosol actuators and more specifically to a two-finger actuator bar for dispensing aerosol sprays.

BACKGROUND OF THE INVENTION

There are numerous actuating mechanisms for dispensing aerosol sprays, the most common of which is the actuator button. The aerosol actuator button is small and accommodates only one finger. The actuator button in common use is so small that it causes finger soreness and fatigue when spraying products for more than a few seconds, which is typically done with products such as spray paints and insecticides. Additionally, the small size of the typical actuator button allows contamination of the finger used to depress the actuator with the product being sprayed. Finally, the actuator button commonly used provides no mechanism for child-proofing. The aerosol container can be dangerous for small children who can easily depress the actuator button releasing the container contents.

Many products resolving some of the shortcomings of actuator buttons are known. These are typically large, complex, cumbersome, and/or expensive to manufacture. There is no simple, easily manufactured device that addresses all the above-noted shortcomings of the common actuator button.

OBJECTS OF THE INVENTION

It is therefore an object of the present invention to provide an actuator bar for aerosol containers that accommodates two fingers to minimize stress and fatigue when spraying from the aerosol container.

Another object of the present invention is to provide an actuator bar that minimizes contamination to the fingers when spraying from an aerosol container.

An additional object of the present invention is to provide an actuator bar that can be adjusted to be child resistant to prevent dangerous release of aerosol fluids by children.

Yet another object of the present invention is to provide an improved actuator bar that is simple and inexpensive to manufacture.

The foregoing specific objects and advantages are illustrative of those which can be achieved with the present invention and are not intended to be exhaustive or limiting of the possible advantages which can be realized. These and other objects and advantages of the present invention will be apparent from the description herein or can be learned from practicing the invention, both as embodied herein or as modified in view of any variations which may be apparent to those skilled in the art.

SUMMARY OF THE INVENTION

The actuator bar of the invention is for use with an aerosol spray container of the type utilizing a tubular valve stem. The actuator bar has a top surface large enough to accommodate two fingers. The actuator bar has two embodiments. One embodiment fits over an existing actuator button. This embodiment has a bottom opening, for slideably mounting the actuator bar over the existing actuator button. It also has a side-wall opening to permit the exit of aerosol spray from the existing actuator button. The actuator bar may be sealably mounted over the actuator button and selectively movable with respect thereto to a closed position and to an open position. In the closed position, the side-wall opening is not aligned with the terminal orifice of the existing actuator button so as to block the flow of fluid from the actuator button. In the open position, the side-wall opening of the actuator bar is aligned with the terminal orifice of the actuator button so as to permit the flow of aerosol fluid out of the terminal orifice of the actuator button. The aerosol spray container may be stored with the actuator bar in the closed position to make it child-proof during storage.

The second embodiment incorporates the functional features of an actuator button. It comprises a body having a front side-wall with a terminal orifice for dispensing fluids from the aerosol spray container. The second embodiment further has a fluid flow passageway in the body extending from the bottom to the front side-wall and having an inlet portion for the inlet of aerosol spray fluid and an outlet portion in fluid flow communication with the terminal orifice.

The second embodiment of the invention may further comprise a nozzle-accepting cavity in the front side-wall and a nozzle sealably fitted into the nozzle-accepting cavity. The nozzle-accepting cavity is centered around the terminal orifice so that the terminal orifice is recessed into the front side-wall. The nozzle has a fluid channel with a nozzle inlet and a nozzle outlet. The nozzle inlet sealably fits over the terminal orifice so as to form a continuous conduit for the flow of aerosol spray from the fluid-flow passageway of the body into the terminal orifice and through the fluid channel exiting the nozzle outlet. The fluid channel in the nozzle may vary in size and shape to accommodate different fluid viscosities and to control the shape of the spray pattern.

With the common actuator button, the finger that depresses the button is likely to be contaminated with aerosol spray because the finger is directly above the terminal orifice. With the actuator bar of the present invention, the fingers are less likely to be contaminated with aerosol spray because the two fingers are not directly above the terminal orifice and, therefore not as close to the spray. Because two fingers operate the actuator bar, the fingers do not fatigue as readily as with the common actuator button which can be operated with only one finger.

DETAILED DESCRIPTION OF THE INVENTION

Figure 2:
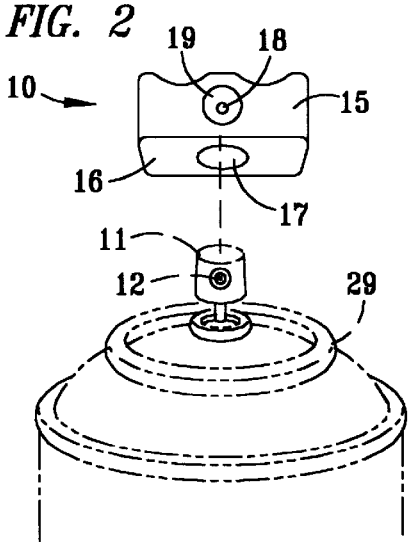
FIG. 2 is an exploded perspective view of a modification of the first preferred embodiment showing how the actuator bar of the invention fits over an existing aerosol spray actuator button.
Figure 3:
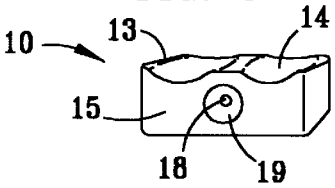
FIG. 3 is a perspective view of a modification of the first preferred embodiment showing the actuator bar from the top.
Figure 4:
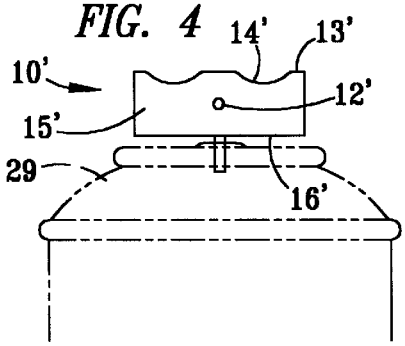
FIG. 4 is front view of the second embodiment of the invention.

The preferred embodiments of the invention are described with reference to the FIGS. 1–7. There are two main embodiments of the invention. The first embodiment is depicted in FIGS. 1–3 and the second is depicted in FIGS. 4–7.

Figure 1:
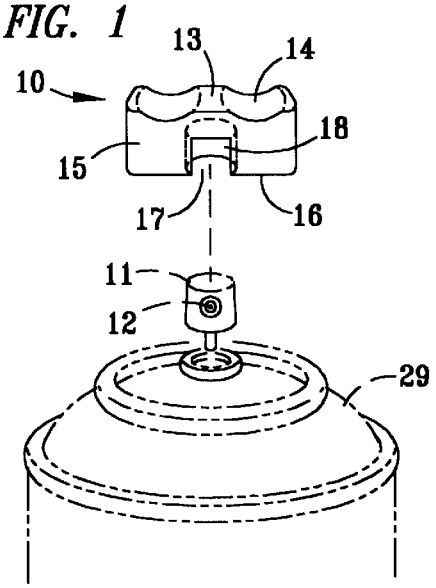
FIG. 1 is an exploded perspective view of the first preferred embodiment showing how the actuator bar of the invention fits over an existing aerosol spray actuator button.

The first preferred embodiment of the invention, as shown in FIG. 1, is an actuator bar 10 for use with an aerosol spray container of the type equipped with an actuator button 11 having a terminal orifice 12 out of which the spray is emitted. The actuator bar 10 comprises a body 13 having a top 14, a front side-wall 15 and a bottom 16 (depicted in FIG. 2), the top 14 being large enough to accommodate at least two fingers. Bottom 16 has a bottom opening 17 for slideably mounting the body 13 over the actuator button 11. The front side-wall 15 has a side-wall opening 18 to permit the exit of aerosol spray. The top 14 is preferably sloped downward from the front side-wall 15 to the back to increase the comfort of prolonged spraying.

As depicted in FIG. 1, the front side-wall opening 15 may extend from the bottom 16 where it merges with bottom opening 17 to within no less than 0.5 mm of the top 14. Alternatively, as depicted in FIGS. 2 and 3, front side-wall opening 15 may comprise a conical passage 19 expanding outwardly from and being centrally aligned with the terminal orifice 12 of the actuator button 11.

The body 13 may be comprised of a material capable of forming a seal so that, when mounted over the actuator button 11, the body is selectively movable with respect thereto to a closed position, in which the terminal orifice is not aligned with the front side-wall opening so as to prevent the flow of fluid from the terminal orifice 12, and to an open position in which the terminal orifice 12 is aligned with the front side-wall opening 18 to permit the flow of fluid from the terminal orifice 12.

In this manner, the actuator bar 10 can be used to child-proof an aerosol container. When the actuator bar 10 is mounted over the actuator button 11 with the front side-wall opening 18 not aligned with the terminal orifice 12, a seal is formed between the actuator bar 10 and the terminal orifice 12 so as to prevent the unintended spraying of the contents of the aerosol container by children. The actuator bar 10 can be turned with respect to the actuator button 11, or removed and remounted over the actuator button 11, so that the front side-wall opening 18 is aligned with the terminal orifice 12 permitting the spraying of fluid from the aerosol container.

In the second embodiment of the invention, as depicted in FIGS. 4–7, the actuator bar 10' is designed to replace the common actuator button and is designed to be used on aerosol spray containers having an outlet orifice that utilizes a tubular valve stem. The actuator bar 10' of this second embodiment is comprised of a body 13' having a top 14', a front side wall 15', and a bottom 16' (depicted in FIGS. 6–7). The top 14' is large enough to accommodate at least two fingers.

Figure 5:
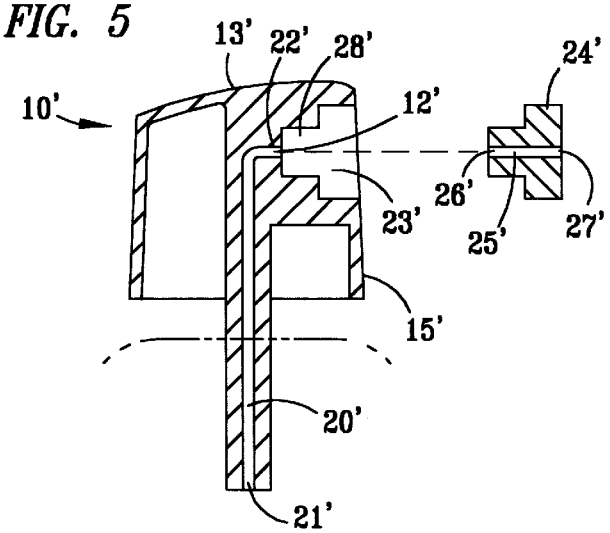
FIG. 5 is a cross-sectional view, along the lines 5—5, of the second embodiment of the invention as depicted in FIG. 7.

The front side-wall 15' has a terminal orifice 12' for dispensing fluids from the aerosol spray container. As depicted in FIG. 5, a fluid-flow passageway 20' is provided in the body 13' extending from the front side-wall 15' to approximately 5 mm to 2 cm beyond the bottom 16'. Fluid-flow passageway 20' has an inlet portion 21' for the inlet of aerosol spray fluid and an outlet portion 22' in fluid flow communication with the terminal orifice 12'.

Figure 6:
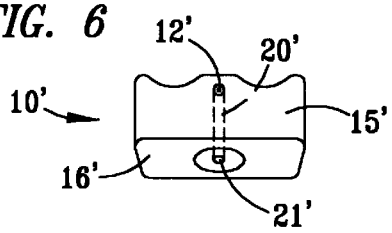
FIG. 6 is a perspective view of one modification of the second embodiment of the invention.
Figure 7:
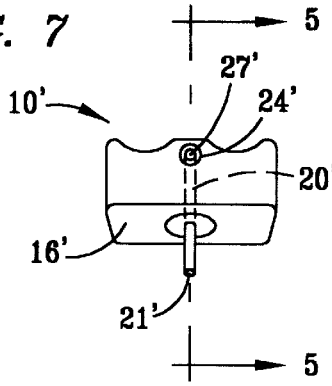
FIG. 7 is a perspective view of a second modification of the second embodiment of the invention.

As shown in FIGS. 5–7, the fluid-flow passageway 20' may be a generally cylindrical conduit operable to engage a valve stem protruding from the aerosol container and forming a seal therewith. Alternatively, as shown in FIG. 7, fluid-flow passageway 20' may further comprise a tubular valve stem extending outwardly from the inlet portion 21' of the fluid-flow passageway 20' for fitting into the outlet orifice of an aerosol spray container.

To accommodate fluids of different viscosities, the actuator bar 10', as shown in FIG. 5, may further comprise a nozzle-accepting cavity 23' in the front side-wall 15', the cavity being centered around the terminal orifice 12' so that the terminal orifice 12' is recessed into the front side-wall 15'. A nozzle 24' is provided for sealably fitting into the nozzle-accepting cavity 23'. The nozzle 24' has a fluid channel 25' with a nozzle inlet 26' for sealably fitting over the terminal orifice 12' and a nozzle outlet 27' to form a continuous conduit for the flow of aerosol spray from the fluid-flow passageway 20' of the body 13' through the terminal orifice 12' and through the fluid channel 25' exiting the nozzle outlet 27'.

The fluid channel 25' of nozzle 24' is preferably a generally cylindrical channel of between 0.25 mm and 2.0 mm in diameter. The diameter and shape of fluid channel 25' will depend on the viscosity of the fluid and on the desired spray pattern. The diameter will be smaller for less viscous fluids, such as volatile pesticides, and larger for more viscous fluids such as paint. By providing nozzle accepting cavity 23', the body 13', may be manufactured using a standard mold in which fluid flow passageway 20' is approximately 0.5 mm to 4 mm in diameter. Only nozzle 24' must be manufactured specifically for fluids of different viscosities. Nozzle 24' is the same as is used in the actuator buttons commonly in use today which are designed to spray fluids of almost any viscosity by varying the diameter and shape of fluid channel 25'.

Although not shown in the drawings, the nozzle-accepting cavity 23' may sealingly engage a cylindrical conduit for applying lubricants such as the product sold under the registered trademark WD-40®. The cylindrical conduit is preferably 2 inches to 10 inches in length and of a diameter suitable for sealingly engaging the narrow portion 28' of nozzle-accepting cavity 23'. By using such a cylindrical conduit, lubricants can be applied more accurately to small parts and in places otherwise hard to reach.

Preferably, body 13' and 13 are smaller than the inner lip 29 of the aerosol container so that it can fit within existing caps (not shown in the drawings) commonly used to cover actuator buttons.

Although the present invention has been shown and described with respect to preferred embodiments, various changes and modifications which are obvious to a person skilled in the art to which the invention pertains are deemed to lie within the spirit and scope of the invention. The two-finger actuator claimed herein can be adapted for use with virtually any aerosol container or any aerosol fluid.

What we claim is:

1. An actuator bar for an aerosol spray container of the type equipped with an actuator button having a terminal orifice out of which the spray is emitted, the actuator bar comprising:

(a) a body having a top, a front side wall, and a button, the top being large enough to accommodate at least two fingers;

(b) the bottom having an opening extending into the body for slideably mounting over the actuator button; and (c) the front side wall having an opening to permit the exit of aerosol spray wherein the opening comprises a conical passage expanding outwardly from and being centrally aligned with the terminal orifice of the actuator button.

2. An actuator bar for an aerosol spray container of the type equipped with an actuator button having a terminal orifice out of which the spray is emitted, the actuator bar comprising:

(a) a body having a top, a front side wall, and a button, the top being large enough to accommodate at least two fingers;

(b) the bottom having an opening extending into the body for slideably mounting over the actuator button;

(c) the front side wall having an opening to permit the exit of aerosol spray; and (d) wherein the body is comprised of a material capable of forming a seal so that when mounted over the actuator button the body is selectively movable with respect thereto to a closed position, in which the terminal orifice is not aligned with the front side-wall opening to prevent the flow of fluid from the terminal orifice, and to an open position in which the terminal orifice is aligned with the front side-wall opening to permit the flow of fluid from the terminal orifice.

* * * * *